US007024868B2

(12) United States Patent
Pye et al.

(10) Patent No.: US 7,024,868 B2
(45) Date of Patent: Apr. 11, 2006

(54) TRANSPORTATION OF LIQUEFIABLE PETROLEUM GAS

(75) Inventors: Graham Christopher Pye, Goedeburg (ZA); Donegal Harold Victor Carroll, Kyalami (ZA)

(73) Assignee: African Oxygen Limited, Johannesburg (ZA)

( * ) Notice: Subject to any disclaimer, the term of this patent is extended or adjusted under 35 U.S.C. 154(b) by 113 days.

(21) Appl. No.: 10/467,753

(22) PCT Filed: Feb. 13, 2002

(86) PCT No.: PCT/IB02/00427

§ 371 (c)(1),
(2), (4) Date: Jan. 8, 2004

(87) PCT Pub. No.: WO02/065015

PCT Pub. Date: Aug. 22, 2002

(65) Prior Publication Data

US 2004/0139752 A1 Jul. 22, 2004

(30) Foreign Application Priority Data

Feb. 13, 2001 (ZA) ..... 2001/1227

(51) Int. Cl.
*F17C 1/00* (2006.01)
*F17C 13/00* (2006.01)
*F17C 3/00* (2006.01)

(52) U.S. Cl. ..... 62/45.1; 220/560.04; 220/560.11; 220/560.12

(58) Field of Classification Search ..... 62/45.1, 62/53.2; 220/560.04, 560.11, 560.12, 560.15
See application file for complete search history.

(56) References Cited

U.S. PATENT DOCUMENTS

| | | | | |
|---|---|---|---|---|
| 2,280,501 A | | 4/1942 | Stephenson | |
| 2,970,559 A | | 2/1961 | Leroux | |
| 2,991,900 A | | 7/1961 | Poorman | |
| 3,830,180 A | * | 8/1974 | Bolton | 114/74 A |
| 4,772,337 A | | 9/1988 | Kesten | 148/12 E |
| 6,012,598 A | * | 1/2000 | Antoniou | 220/1.5 |
| 6,026,975 A | * | 2/2000 | Slater | 220/565 |
| 6,085,528 A | | 7/2000 | Woodall et al. | 62/45.1 |
| 2003/0106324 A1 | * | 6/2003 | Bishop | 62/45.1 |

OTHER PUBLICATIONS

International Search Report corresponding to PCT/IB02/00427 mailed on Feb. 11, 2003.

* cited by examiner

*Primary Examiner*—William C. Doerrler
(74) *Attorney, Agent, or Firm*—Myers Bigel Sibley & Sajovec, P.A.

(57) ABSTRACT

A pressure vessel for transportation of liquefiable petroleum gas (LPG) is cylindrical with a circular cross-sectional profile. The wall thickness of the vessel (in meters) multiplied by a design strength of the material from which the vessel is made (in megapascals) is less than 0.8 times the internal diameter of the vessel (in meters). The design strength is the yield strength divided by 1.5 or the tensile strength divided by 2.5. The wall thickness is between 3 mm and 11 mm. The diameter is between 1 and 2.6 m. The vessel have have an external insulating and fire resistant cladding. It may also have a cooling plant for cooling the LPG.

15 Claims, 2 Drawing Sheets

TRANSPORTATION OF LIQUEFIABLE PETROLEUM GAS

RELATED APPLICATIONS

Figure 1:
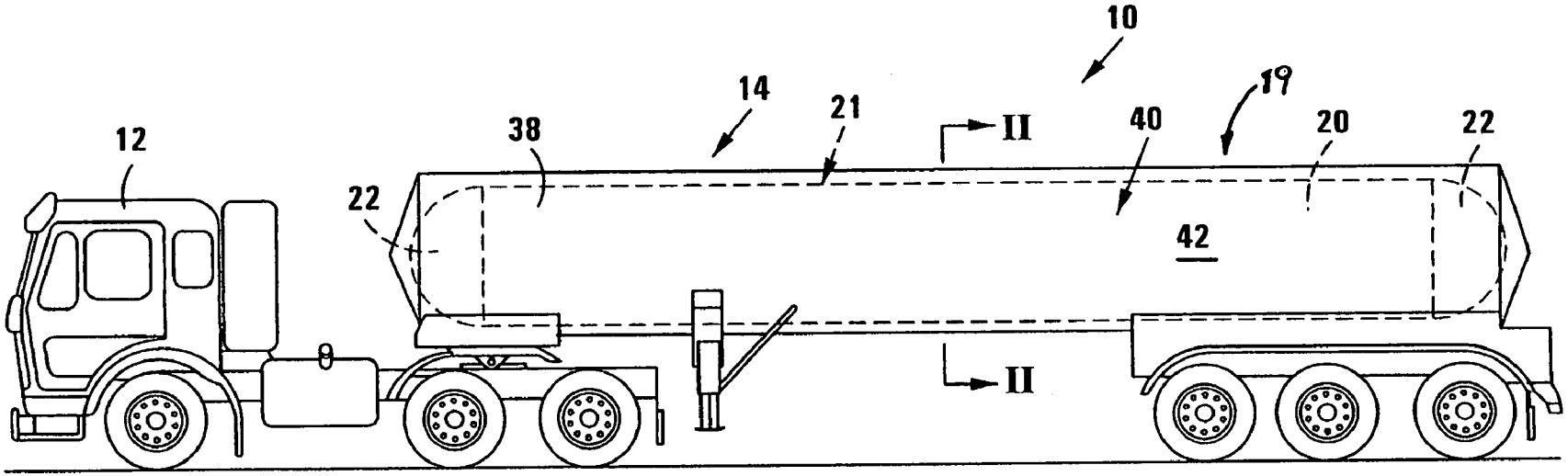

This application claims priority under 35 U.S.C. §371 from PCT Application No. PCT/IB02/00427, filed in English on Feb. 13, 2002, which claims priority to South African Application No. 2001/1227, filed Feb. 13, 2001, the disclosures of which are incorporated by reference herein in their entireties.

THIS INVENTION relates to the transportation of liquefiable petroleum gas (LPG). In particular, it relates to a transportable pressure vessel assembly for housing liquefiable petroleum gas, to a vehicle which includes such a pressure vessel assembly, and to a method of transporting liquefiable petroleum gas.

According to one aspect of the invention, there is provided a transportable pressure vessel assembly for housing liquefiable petroleum gas, which includes a pressure vessel that is generally cylindrical, having a circular cross-sectional profile, and being dimensioned such that a value (R) expressed by $$R = \left(\frac{e \times f}{D}\right) \times 10$$

is smaller than approximately 8 megapascals, wherein e is a thickness of a cylindrical wall of the pressure vessel, in meters;

f is a design strength of a material from which the pressure vessel is made, in megapascals; and D is an internal diameter of the pressure vessel, in meters.

The design strength of the material is defined as the minimum of either the yield strength divided by 1.5 or the tensile strength divided by 2.5. The yield strength and tensile strength for the material are as per recognized material standard specifications.

The term "transportable pressure vessel assembly" as used herein is intended to mean any pressure vessel assembly which is designed and/or configured for transport by a land transport vehicle, such as a road transport vehicle, a train, or the like.

Typically, the thickness (e) of the wall of the pressure vessel is 0.003 to 0.011 m, while the internal diameter (D) of the pressure vessel may be 1 to 2.6 m. A pressure vessel having these dimensions should be readily transportable by conventional road transport vehicles, such as heavy transport trucks.

The pressure vessel assembly may include a temperature control means operatively associated with the pressure vessel, to control the temperature of LPG in the pressure vessel.

The term "temperature control means" as used herein is intended to include any arrangement for permitting, at least, an increased degree of control over the temperature of LPG in the pressure vessel, or for reducing or inhibiting the rate of change of temperature of LPG in the pressure vessel. The temperature control means thus includes insulation means, cooling means, and the like.

In a particular embodiment of the invention, the temperature control means is an insulation means for insulating the pressure vessel to inhibit heat transfer between the atmosphere and the interior of the pressure vessel.

The insulation means may be a thermal insulation jacket provided on the pressure vessel. Advantageously, the thermal insulation jacket may be of a fire resistant material. In one such embodiment, the insulation jacket includes a number of continuous circumferentially extending layers of ceramic fibre blanket, the layers being located radially outwardly of the pressure vessel.

The pressure vessel assembly may, in addition, have a circumferentially extending layer of cladding around the insulation jacket, so that the insulation jacket is sandwiched between the wall of the pressure vessel and the layer of cladding, the layer of cladding defining the outer surface of the pressure vessel assembly.

In another embodiment of the invention, the temperature control means is in the form of a cooling means for cooling liquefiable petroleum gas in the pressure vessel. The cooling means may, for instance, be a refrigeration plant which includes a cooling element operatively connected to the refrigeration plant and located within the pressure vessel, for refrigerating liquefiable petroleum gas in the pressure vessel.

According to another aspect of the invention, there is provided a land transport vehicle which includes a transportable pressure vessel assembly as described above.

The vehicle may, for instance, be a road transport vehicle, such as a heavy transport vehicle.

According to a further aspect of the invention, there is provided a method of transporting a liquefiable petroleum gas, which method includes the steps of housing liquefiable petroleum gas in a pressure vessel assembly as described above, and transporting the pressure vessel to a desired location.

Typically, the method includes the step of controlling the temperature of the liquefiable petroleum gas in the pressure vessel.

The step of controlling the temperature of the liquefiable petroleum gas may include cooling the liquefiable petroleum gas.

Figure 2:
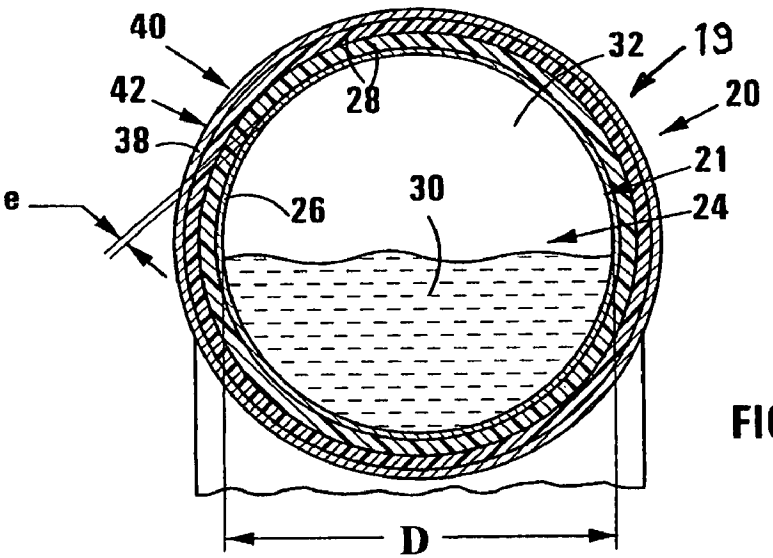
Figure 3:
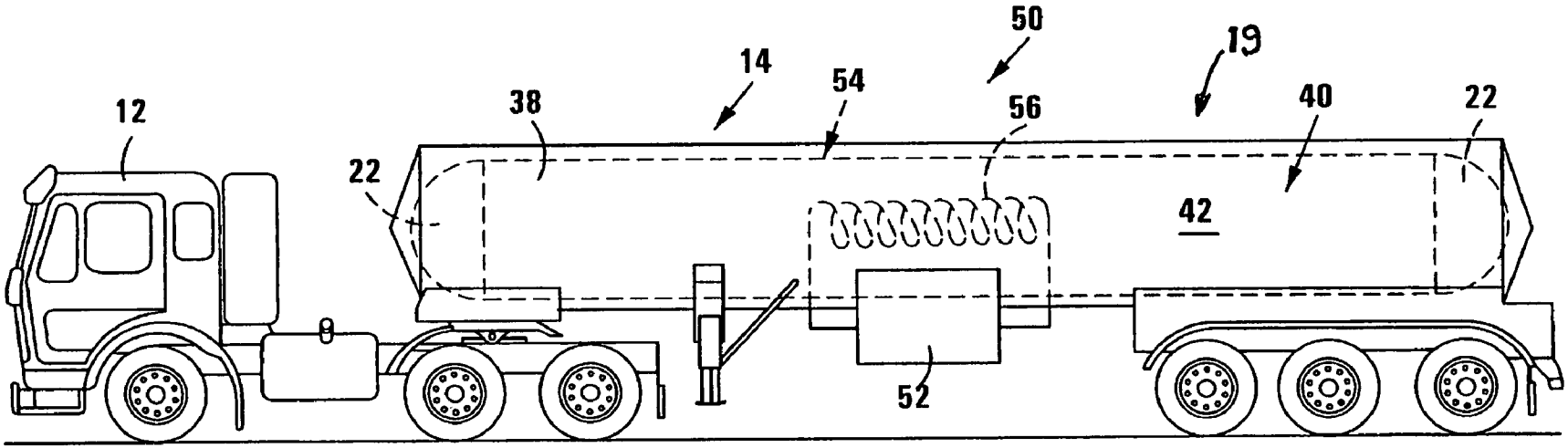

The invention will now be further described, by way of example, with reference to the accompanying diagrammatic drawings, in which FIG. 1 is a schematic side-elevation of a vehicle in accordance with the invention; and FIG. 2 is a schematic cross-section of a pressure vessel assembly forming part of the vehicle of FIG. 1, on an enlarged scale, taken at II—II in FIG. 1; and FIG. 3 is a schematic side-elevation of a further embodiment of a vehicle in accordance with the invention.

In FIGS. 1 and 2 of the drawings, reference numeral 10 generally indicates a vehicle in accordance with the invention. The vehicle is a road transport vehicle in the form of a transport tanker 10. The tanker 10 includes a horse or truck 12, which is connected to a trailer 14 on which a load is supported, the load being a pressure vessel assembly 19 for housing liquefiable petroleum gas (LPG) 24. The assembly 19 includes a pressure vessel 20 that is cylindrical, having a circular cross-sectional profile, with hemispherical ends 22 closing off the cylindrical portion to form an enclosed storage space 21. It will be appreciated that, in other embodiments of the invention, the ends can be ellipsoidal, or can have any other suitable shape.

In this example, the liquefiable petroleum gas 24 contained in the pressure vessel 20 is a mixture of propane and butane. At conventional operating temperatures, the LPG 24 is partly liquid 30 and partly gas 32. The volume of the storage space 21 occupied by the gas phase LPG 32 is referred to as the ullage.

A cylindrical wall 26 of the pressure vessel 20 is of plate steel having a constant thickness (e). The pressure vessel 20 is covered by an insulation jacket 40 of a thermal insulation material. In this case, the thermal insulation jacket 40 includes two circumferentially extending continuous layers 28 of 64 kg/m$^2$ ceramic fibre blanket, each layer 28 being approximately 25 mm thick, and the inner layer 28 being in contact with the radially outwardly facing surface of the pressure vessel wall 26. A radially outer, circumferentially extending layer of stainless steel cladding 38 is provided around the insulation jacket 40. This insulation jacket 40 thus not only provides thermal insulation to the pressure vessel 20, but also offers protection against the impingement of fire on the pressure vessel 20.

In use, the insulation jacket 40 inhibits heat transfer between the atmosphere and the interior of the pressure vessel 20, as the combination of the pressure vessel wall 26 and the insulation jacket 40 has a considerably higher coefficient of thermal conductivity than the pressure vessel walls of conventional LPG tankers, which often comprise only steel plate. An outer surface 42 of the cladding 38 also has a relatively high coefficient of surface absorptivity, to inhibit the absorption of heat from solar radiation. Conventionally, refrigerated LPG is loaded into a transportable pressure vessel assembly which is then transported to a desired location, the temperature of the LPG in the tanker gradually increasing owing to heat transfer between the interior of the pressure vessel and the atmosphere, which is usually at a higher temperature.

As a result of the insulation jacket 40, the rate of increase of the temperature of the LPG 24 in the pressure vessel 20 will be less than that of LPG housed in a conventional uninsulated pressure vessel. During a test conducted by the Applicant, the tanker 10 and a conventional uninsulated tanker were exposed to extreme operating conditions. After exposure to these conditions for a particular amount of time, the temperature of the LPG 24 in the insulated vessel 20 was approximately 40° C., compared to approximately 53° C. for the LPG in the control tanker. As a result of its lower temperature, the pressure of the gas portion 32 of the LPG 24 in the pressure vessel 20 was also lower, being about 1.35 Mpa (absolute), as opposed to about 1.8 Mpa (absolute) of the control tanker.

Conventionally, a maximum expected temperature (design temperature), or a corresponding maximum expected gas pressure (design pressure), of LPG in a pressure vessel is used as a point of departure for calculating the dimensions of the pressure vessel according to a standardised design code. An eventual thickness (e) of a wall of the pressure vessel is directly proportional to the design pressure, while an internal diameter (D) of the pressure vessel is inversely proportional to the design pressure.

The Applicant has found that a lower design pressure, or a lower design temperature, can be used for calculating the dimensions of the pressure vessel 20 when it is provided with the insulation jacket 40. This lower design temperature results in the pressure vessel 40 being designed to have a smaller wall thickness (e) and/or a larger internal diameter (D) than would normally be the case. The Applicant has thus found that the dimensions of the pressure vessel 20 can be designed in accordance with a standardised design code by using the reduced design pressure as a point of departure, such that a value (R) which is expressed by $$R = \left(\frac{e \times f}{D}\right) \times 10$$

is equal to or smaller than about 8 megapascals, which is not the case with conventional transportable pressure vessels. In this case, the design codes used were BS5500 and BS7122, although similar results will follow from using other standard design codes such as ASME 8 or AS1210.

The pressure vessel 20 was designed in accordance with this approach, using a reduced design pressure of 1.3 MPa (gauge pressure). The calculated thickness (e) of the steel plate forming the wall 26 of the pressure vessel 20 is approximately 0.0084 m, the steel having a design strength of about 208 Mpa. The internal diameter (D) of the pressure vessel 20 is 2.44 m. Consequently, the value of R is about 7.16 Mpa.

The wall thickness (e) thus calculated is smaller than would have been the case with a conventional design approach. This reduced thickness (e) leads to a considerable reduction in the tare mass of the tanker 10. The truck 12 thus has a lighter load to tow, and transport costs are reduced due to improved efficiency. In cases where the amount of LPG 24 which can be carried by a tanker is limited by the power of the truck, more LPG can be carried by the tanker if it is provided with the transportable pressure vessel 20 having the insulation jacket 40. Naturally, this will only be the case if the insulation jacket 40 has a mass which is lower than the difference in mass between a conventional pressure vessel and the pressure vessel 20 with a reduced wall thickness. If a different design approach is followed, the pressure vessel 21 can be designed to have a larger internal diameter (D), leading to obvious advantages.

The Applicant has further found that, with the insulated pressure vessel 20, a smaller ullage is required than is the case with conventional pressure vessels.

In FIG. 3 of the drawings, reference numeral 50 indicates a further embodiment of a LPG tanker in accordance with the invention, with like reference numerals indicating like parts in the embodiment of FIGS. 1 and 2, and the embodiment of FIG. 3.

The tanker 50 has a pressure vessel 54 and insulation jacket 40 similar to that of the tanker 10 of FIGS. 1 and 2, but the tanker 50 includes a cooling means in the form of a refrigeration plant 52 carried on the trailer 14 and operatively associated with the pressure vessel 20 to cool the LPG 24 in the pressure vessel 54. To this end, the refrigeration plant 52 is provided with a cooling element 56 comprising a number of coils located in the storage space 21 of the pressure vessel 20.

In use, the refrigeration plant 52, via the cooling element 56, cools the LPG 24 in the pressure vessel 20, thus limiting the temperature of the LPG 24 to a predetermined value. Although the insulation jacket 40 assists in controlling the temperature of the LPG 24 by inhibiting heat transfer through the pressure vessel wall 26, it will be appreciated that the insulation jacket 40 can be omitted, if desired. Due to the operation of the refrigeration plant 52, the temperature of the LPG 24 in the pressure vessel 54 will not rise above the predetermined value, so that the dimensions of the pressure vessel 54 can be calculated accordingly, using said predetermined temperature as design temperature.

The invention claimed is:

1. A transportable pressure vessel assembly for housing liquefiable petroleum gas, which comprises a pressure vessel that is generally cylindrical, having a circular cross-sectional profile; and a temperature control means operatively associated with the pressure vessel, the pressure vessel being dimensioned such that a value (R) expressed by $$R = \left(\frac{e \times f}{D}\right) \times 10$$

is smaller than approximately 8 megapascals, wherein e is a thickness of a cylindrical wall of the pressure vessel, in meters;

f is a design strength of a material from which the pressure vessel is made, in megapascals; and D is an internal diameter of the pressure vessel, in meters.

2. The pressure vessel assembly as claimed in claim 1, in which the thickness (e) of the cylindrical wall of the pressure vessel is between 0.003 and 0.011 m.

3. The pressure vessel assembly as claimed in claim 1, in which the internal diameter (D) of the pressure vessel is between 1 and 2.6 m.

4. The pressure vessel assembly as claimed in claim 1, in which the temperature control means is an insulation means for insulating the pressure vessel to inhibit heat transfer between the atmosphere and the interior of the pressure vessel.

5. The pressure vessel assembly as claimed in claim 4, in which the insulation means is a thermal insulation jacket provided on the pressure vessel.

6. The pressure vessel assembly as claimed in claim 5, in which the thermal insulation jacket is of a fire resistant material.

7. The pressure vessel assembly as claimed in claim 5, in which the thermal insulation jacket comprises a number of continuous circumferentially extending layers of ceramic fire blanket, the layers being located radially outwardly of the pressure vessel.

8. The pressure vessel assembly as claimed in claim 5, which further comprises a circumferentially extending layer of cladding around the thermal insulation jacket, so that the thermal insulation jacket is sandwiched between the wall of the pressure vessel and the layer of cladding.

9. The pressure vessel assembly as claimed in claim 1 in which the temperature control means comprises a cooling means for cooling liquefiable petroleum gas in the pressure vessel.

10. The pressure vessel assembly as claimed in claim 9, in which the cooling means is a refrigeration plant which comprises a cooling element operatively connected to the refrigeration plant and located within the pressure vessel, for refrigerating liquefiable petroleum gas in the pressure vessel.

11. A land transport vehicle which comprises the transportable pressure vessel assembly as claimed in claim 1.

12. The land transport vehicle as claimed in claim 11, wherein the vehicle is a road transport vehicle.

13. A method of transporting liquefiable petroleum gas, which method comprises the steps of housing liquefiable petroleum gas in the pressure vessel assembly as claimed in claim 1, and transporting the pressure vessel assembly to a desired location.

14. The method as claimed in claim 13, which further comprises the step of controlling the temperature of the liquefiable petroleum gas in the pressure vessel.

15. The method as claimed in claim 14, in which the step of controlling the temperature of the liquefiable petroleum gas comprises cooling the liquefiable petroleum gas.

* * * * *

UNITED STATES PATENT AND TRADEMARK OFFICE

CERTIFICATE OF CORRECTION

PATENT NO. : 7,024,868 B2
APPLICATION NO. : 10/467753
DATED : April 11, 2006
INVENTOR(S) : Pye et al.

It is certified that error appears in the above-identified patent and that said Letters Patent is hereby corrected as shown below:

Column 5,
Lines 9-10 should read -- f is the minimum of either the yield strength divided by 1.5 or the tensile strength divided by 2.5 of a material from which the pressure vessel is made, in megapascals; and --

Signed and Sealed this

Seventh Day of November, 2006

JON W. DUDAS
*Director of the United States Patent and Trademark Office*